US012471699B2

(12) United States Patent
Ho

(10) Patent No.: US 12,471,699 B2
(45) Date of Patent: Nov. 18, 2025

(54) HEIGHT-ADJUSTABLE TABLE

(71) Applicant: OXTI Pte Ltd, Singapore (SG)

(72) Inventor: Chih-Feng Ho, Singapore (SG)

(73) Assignee: OXTI PTE LTD, Singapore (SG)

( * ) Notice: Subject to any disclaimer, the term of this patent is extended or adjusted under 35 U.S.C. 154(b) by 117 days.

(21) Appl. No.: 18/525,776

(22) Filed: Nov. 30, 2023

(65) Prior Publication Data

US 2025/0176706 A1 Jun. 5, 2025

(51) Int. Cl.
*A47B 9/20* (2006.01)
*A47B 9/02* (2006.01)

(52) U.S. Cl.
CPC ..... *A47B 9/20* (2013.01); *A47B 9/02* (2013.01); *A47B 2200/0052* (2013.01)

(58) Field of Classification Search
CPC .... A47B 9/20; A47B 9/12; A47B 9/02; A47B 2200/0052
See application file for complete search history.

(56) References Cited

U.S. PATENT DOCUMENTS 3,905,311 A * 9/1975 Carpentier ..... A47B 23/046 108/147
5,311,827 A * 5/1994 Greene ..... F16M 11/18 74/89.22
2015/0320198 A1* 11/2015 Zebarjad ..... A47B 9/00 248/188.5
2016/0227921 A1* 8/2016 Hansen ..... A47B 9/02
2016/0265713 A1* 9/2016 Sweere ..... F16M 13/02
2017/0000257 A1* 1/2017 Ergun ..... A47B 9/02
2020/0077788 A1* 3/2020 Albers ..... A47B 9/20
2020/0163451 A1* 5/2020 Tao ..... A47B 9/10
2020/0170403 A1* 6/2020 Franz ..... A47B 9/06
2023/0218076 A1* 7/2023 Chumakov ..... A47B 9/06 108/20

* cited by examiner

*Primary Examiner* — Daniel J Rohrhoff
(74) *Attorney, Agent, or Firm* — Leong C. Lei

(57) ABSTRACT

The height-adjustable table includes a tabletop, a lifting member, a positioning member, a cushioning member, and a braking member. The lifting member includes a base and a lifting platform slidably telescoped within the base. The lifting platform is connected to the tabletop. The positioning member is configured on the base. The cushioning member includes a first pulley, a second pulley, and an elastic piece. The first and second pulleys are positioned inside the lifting platform. The elastic piece's two ends are respectively connected a first rope and a second rope, respectively wrapped around the first and second pulleys. The braking member is configured on the lifting member. The height-adjustable table utilizes the cushioning member to enable the lifting platform to smoothly ascend and descend, the positioning member to lock the lifting platform at a desired position, and the braking member to stop the lifting platform from moving.

5 Claims, 9 Drawing Sheets

HEIGHT-ADJUSTABLE TABLE

BACKGROUND OF THE INVENTION

(a) Technical Field of the Invention

The present invention generally relates to desks, and more particularly to a height-adjustable table.

(b) Description of the Prior Art

Republic of China, Taiwan, Patent No. M599594, titled "Improved structure of lifting table," discloses a height-adjustable table including a base, a tabletop, a connecting base, and a lifting device for the tabletop. The lifting device is composed of an inner tube, a hydraulic piston rod, a pulley seat, an outer tube, and a fixing sea, as revealed by the patent's FIG. 2.

Although the aforementioned conventional height-adjustable table can solve the problems of wobbling and impact noise generation, its structure is complex with a large number of components, and there is still room for improvement.

SUMMARY OF THE INVENTION

Therefore, the present invention discloses a novel height-adjustable table, including a tabletop, a lifting member, a positioning member, a cushioning member, and a braking member. The lifting member includes a base and a lifting platform. The lifting platform is slidably telescoped within the base, and the lifting platform is connected to the tabletop. The positioning member is configured on the base. The cushioning member includes a first pulley, a second pulley, and an elastic piece. The first pulley and the second pulley are positioned inside the lifting platform. The elastic piece's two ends are respectively connected a first rope and a second rope. The first rope is wrapped around the first pulley, and the second rope is wrapped around the second pulley. The braking member is configured on the lifting member.

Specifically, the lifting member further includes a rail structure.

Specifically, the positioning member includes an operating piece and a locking piece. The operating piece is connected to the locking piece.

Specifically, the elastic piece is a spring.

Specifically, the braking member includes a number of brake pads and a lever piece. The brake pads are positioned within the lifting platform around the second pulley. The lever piece is connected to the brake pads.

As described above, the height-adjustable table utilizes the installation of the cushioning member to enable the lifting platform to smoothly ascend and descend relative to the base. Additionally, it uses the positioning member to lock the lifting platform at a desired position relative to the base. It also uses the braking member to stop the lifting platform from moving up and down.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
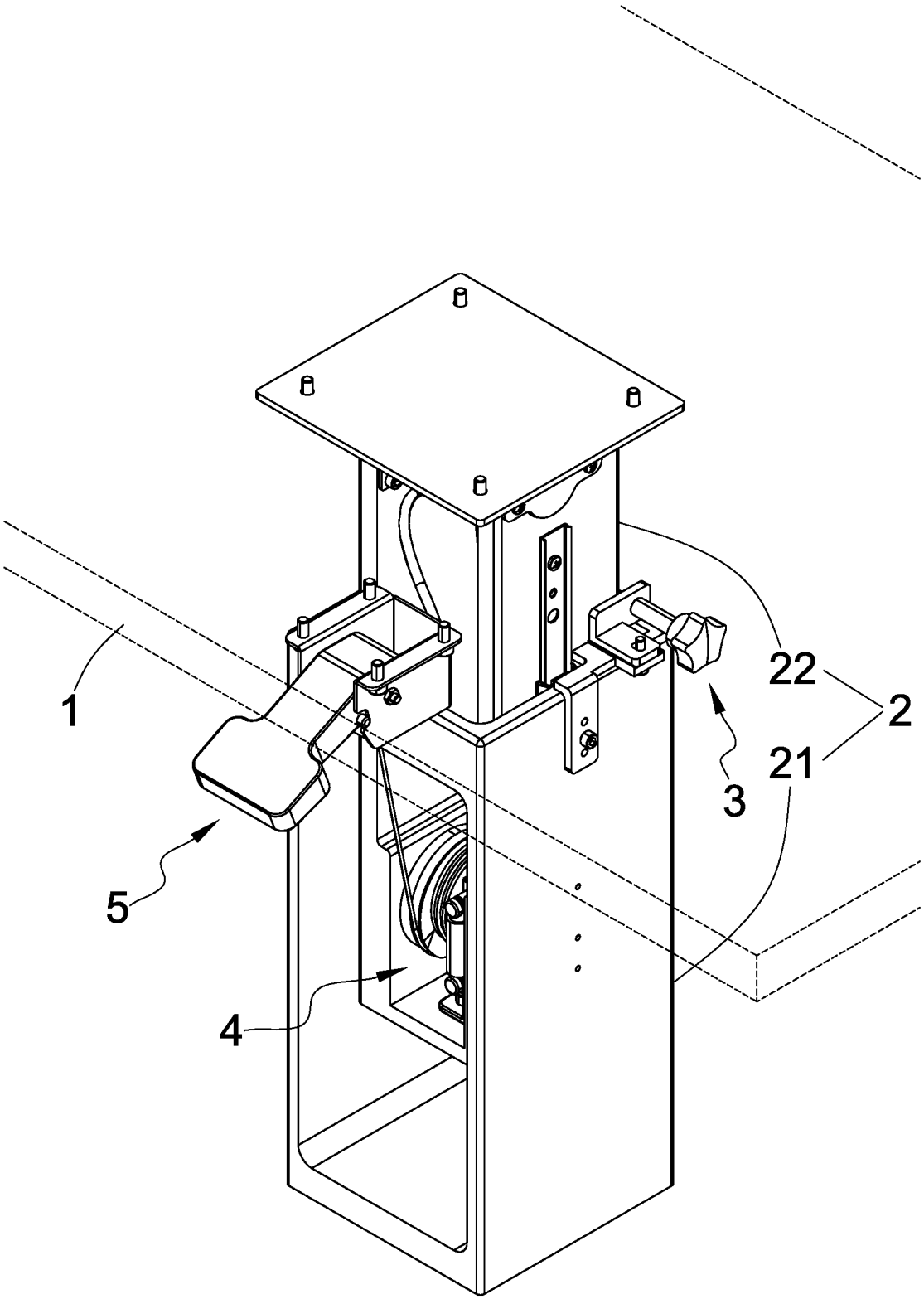
FIG. 1 is a perspective diagram showing a height-adjustable table according to an embodiment of the present invention.
Figure 2:
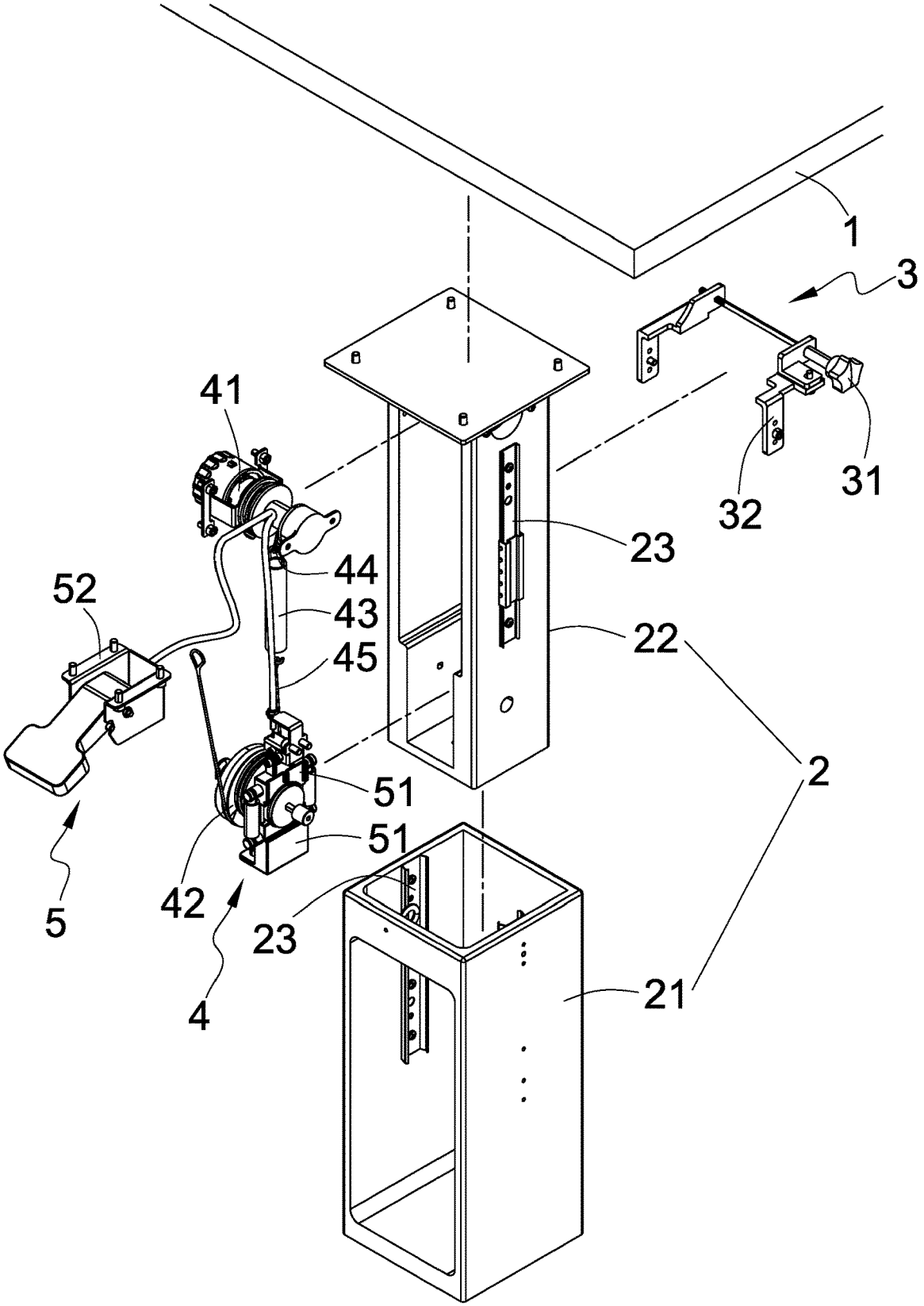
FIG. 2 is a perspective breakdown diagram showing the height-adjustable table of FIG. 1.

As shown in FIGS. 1 and 2, a height-adjustable table according to an embodiment of the present invention includes a tabletop 1, a lifting member 2, a positioning member 3, a cushioning member 4, and a braking member 5.

The tabletop 1 can be one used for a computer desk, writing desk, dining table, or conference table.

The lifting member 2 includes a base 21 and a lifting platform 22, with the lifting platform 22 being slidably telescoped within the base 21. A top end of the lifting platform 22 is connected to a bottom side of the tabletop 1. The lifting member 2 is equipped with a rail structure 23, which includes multiple rails such as inner rails, outer rails, and intermediate rails. The outer rails are vertically fixed to an inner wall of the base 21, while the inner rails are vertically fixed to an outer surface of the lifting platform 22. The intermediate rails are slidably positioned between the outer rails and the inner rails so that intermediate rails and the inner rails may slide relative to the outer rails, thereby enabling the lifting platform 22 to move up and down relative to the base 21 and extending the lifting range of the lifting platform 22.

Figure 3:
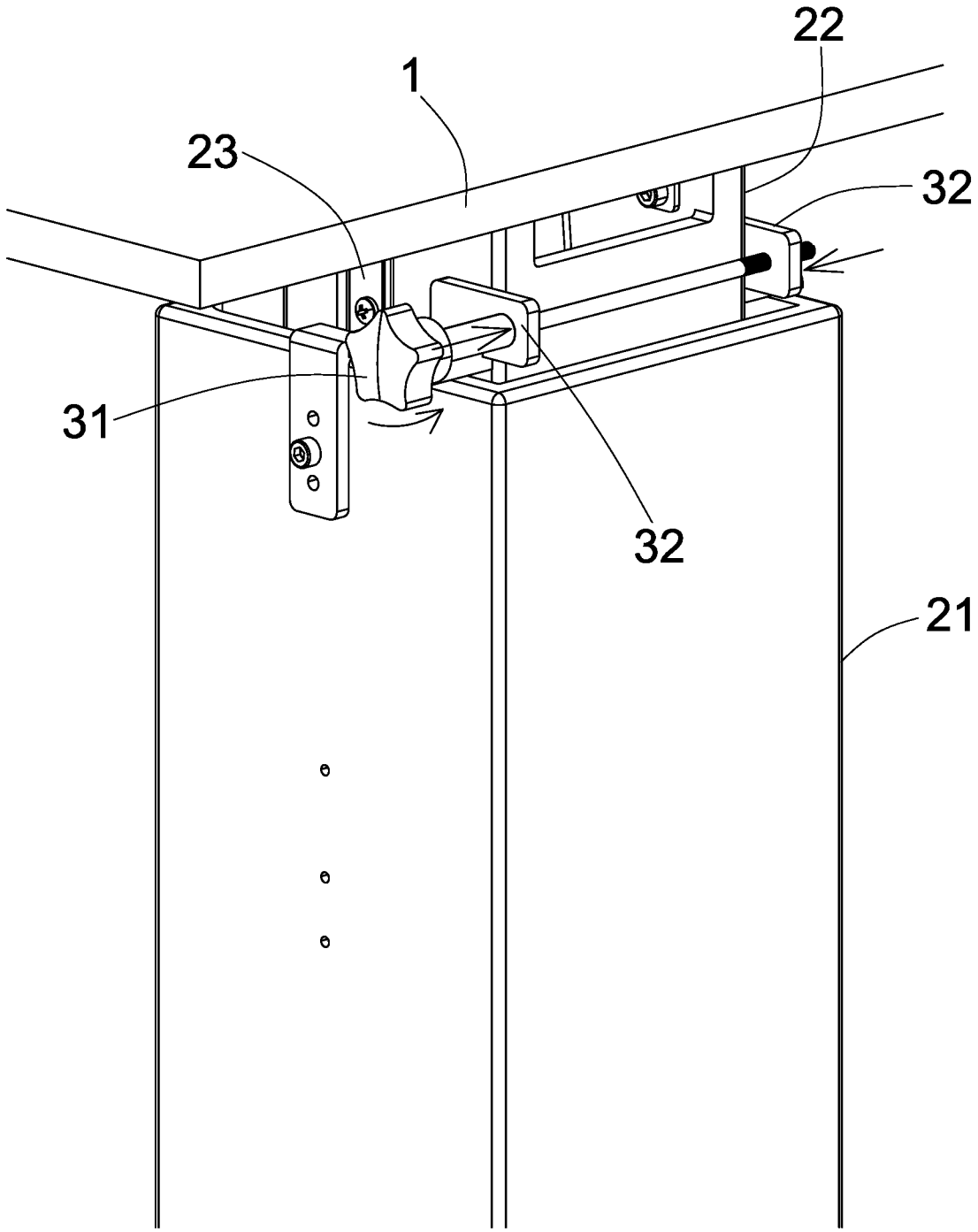
FIG. 3 is a perspective diagram showing a positioning member of the height-adjustable table of FIG. 1.

As shown in FIGS. 2 and 3, The base 21 is equipped with a positioning member 3. This positioning member 3 includes an operating piece 31 and a locking piece 32. The operating piece 31 is connected to the locking piece 32, and the locking piece 32 is used to stop the movement of the lifting platform 22. By using the operating piece 31, the locking piece 32 can be brought into contact with the lifting platform 22, creating a locked state in which the locking piece 32 prevents the lifting platform 22 from sliding, thereby stopping its movement. Similarly, by using the operating piece 31, the locking piece 32 can be disengaged from the lifting platform 22, releasing the locked state and allowing the lifting platform 22 to resume sliding.

Figure 4:
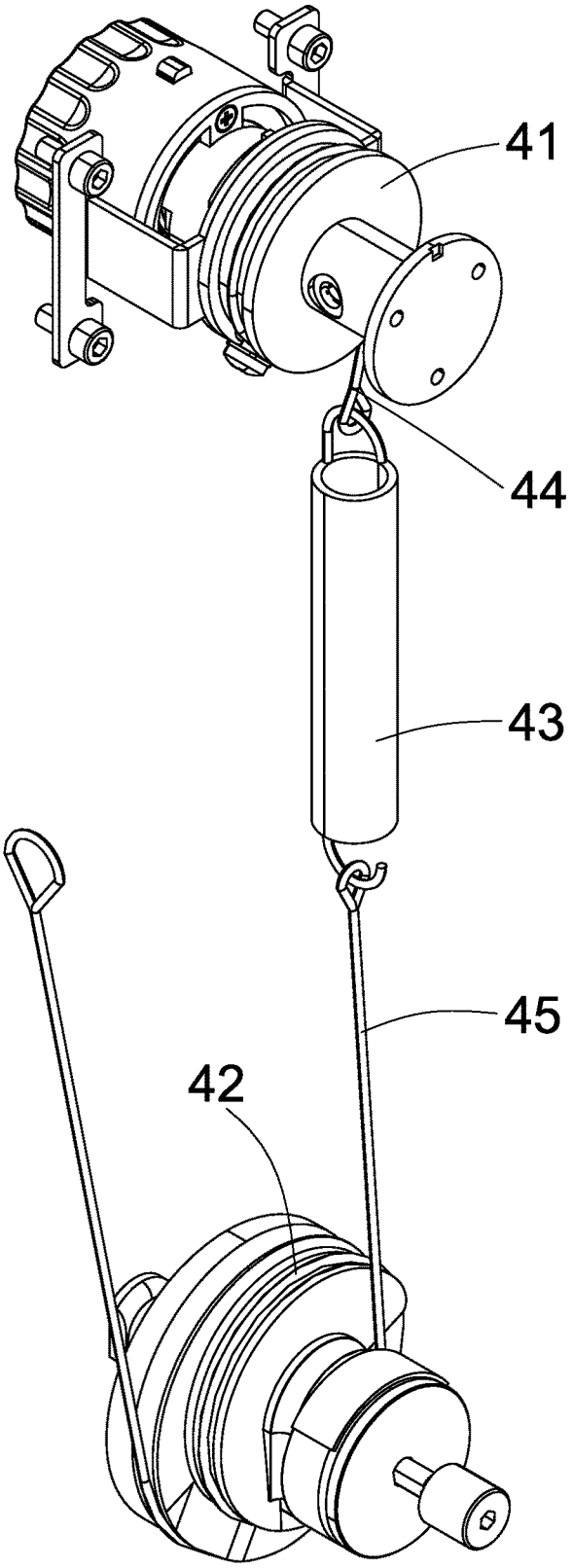
FIG. 4 is a perspective diagram showing a cushioning member of the height-adjustable table of FIG. 1.

As shown in FIGS. 2 and 4, the cushioning member 4 includes a first pulley 41, a second pulley 42, and an elastic piece 43. The first pulley 41 and the second pulley 42 are positioned inside the lifting platform 22. The two ends of the elastic piece 43 are respectively connected to a first rope 44 and a second rope 45. The first rope 44 is wrapped around the first pulley 41 and fixed at one end to the first pulley 41. The second rope 45 is wrapped around the second pulley 42 and fixed at one end to the base 21 (indicated in FIG. 6A). The elastic piece 43 can be a spring. The cushioning member 4 utilizes the elastic piece 43 to reduce the impact force during the lifting motion.

Figure 6:
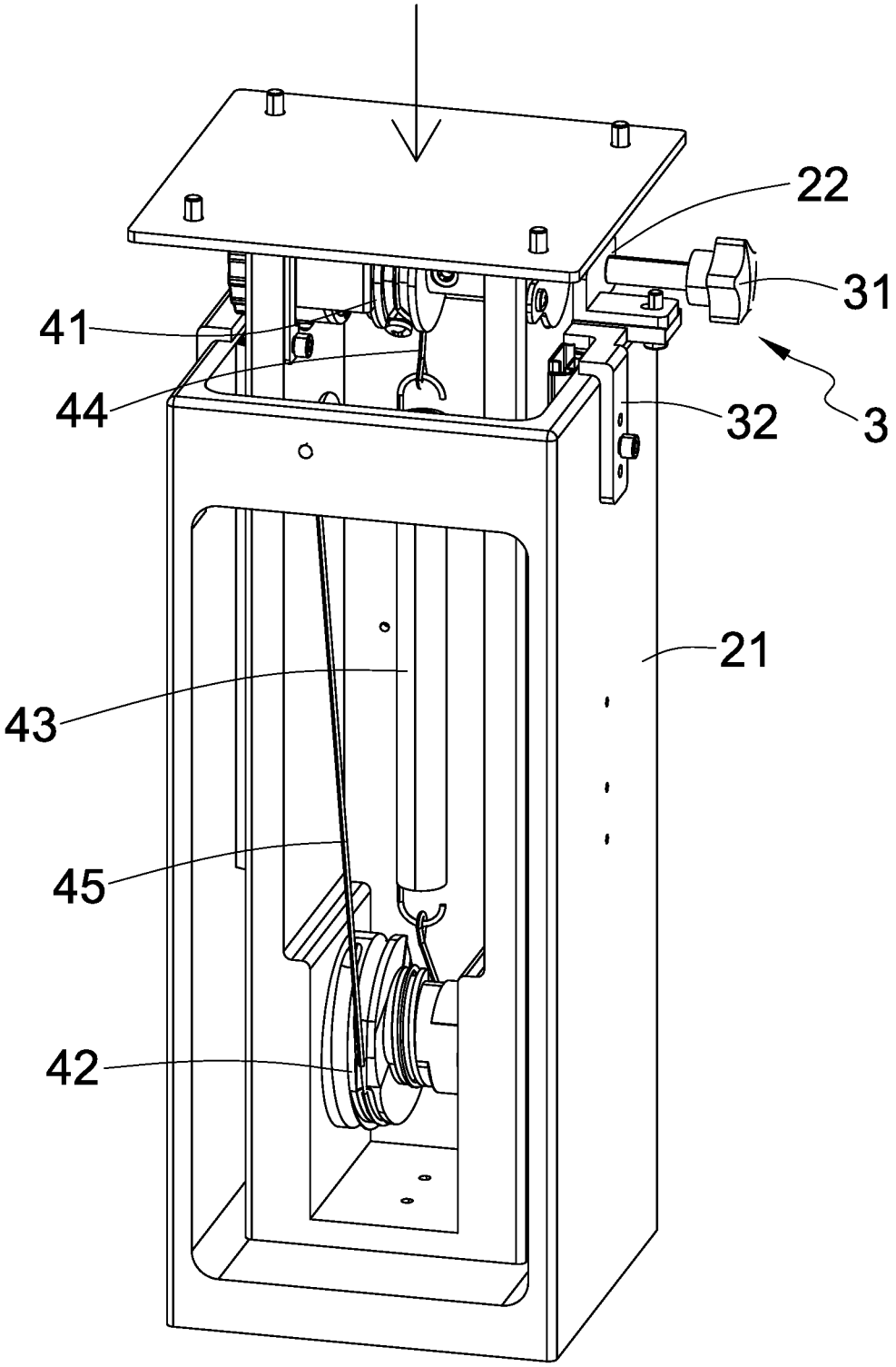
FIG. 6 is a perspective diagram showing a scenario that a tabletop of the height-adjustable table of FIG. 1 descends.
Figure 6A:
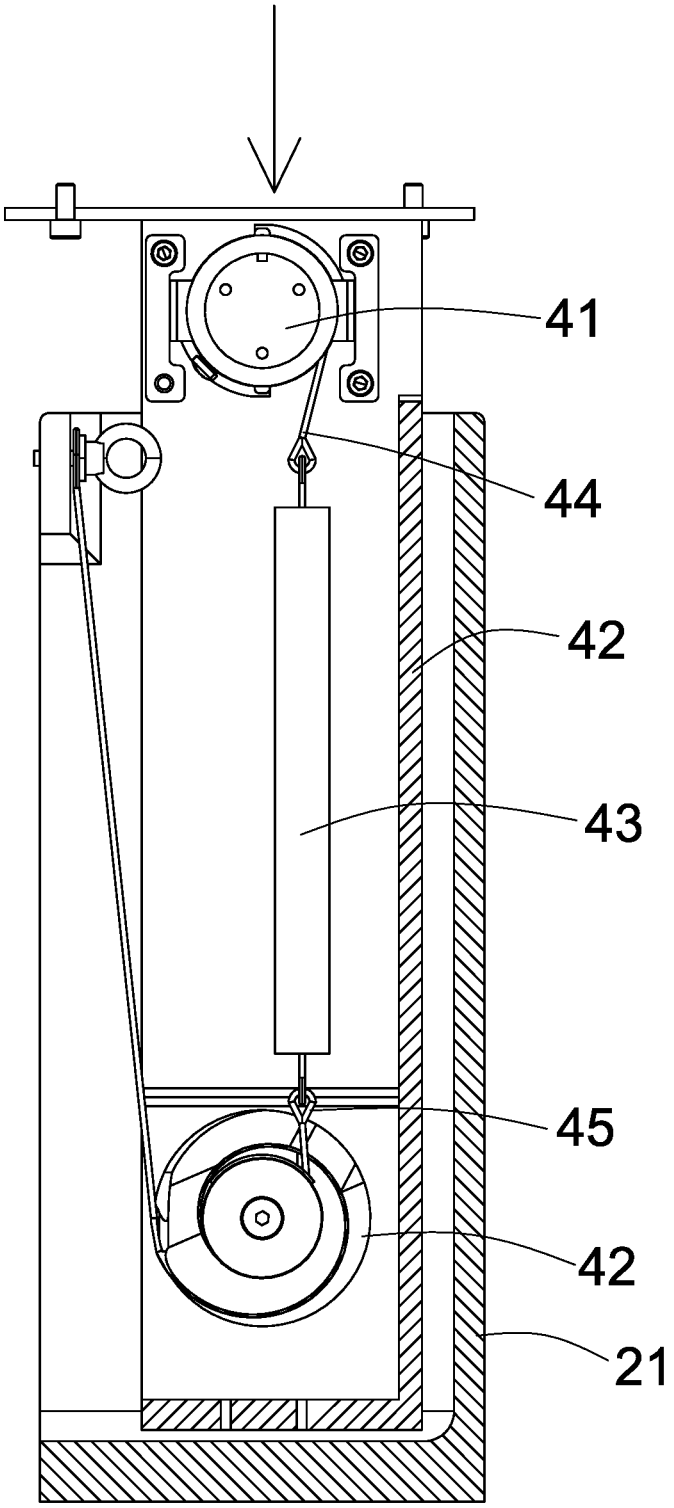
FIG. 6A is a sectional diagram showing a scenario that a tabletop of the height-adjustable table of FIG. 1 descends.

As shown FIGS. 6 and 6A, when the lifting platform 22 descends, the elastic piece 43 is capable of absorbing and dispersing the impact force generated during the descent of the lifting platform 22. This prevents the lifting platform 22 from descending too quickly, utilizing the elastic deformation of the elastic piece 43 to absorb the impact force of the lifting platform 22's descent, ensuring a smooth descent of the lifting platform 22 relative to the base 21.

The operation of the height-adjustable table is described as follows.

FIGS. 1 and 2 show that the height-adjustable table is in an initial state, where the tabletop 1 is not under the influence of any external force.

As shown in FIGS. 2, 6, and 6A, when the tabletop 1 is subjected to a downward force, the lifting platform 22 can move downward through the rail structure 23. The lifting platform 22 descends relative to the base 21. Because the second rope 45 is wrapped around the second pulley 42 and fixed at one end to the base 21, and the second rope 45 is connected to the elastic piece 43, the elastic piece 43 can absorb the impact force generated during the descent of the lifting platform 22. The elastic piece 43 is stretched, producing elastic deformation and storing potential energy, allowing the lifting platform 22 to maintain a relatively stable downward speed and reducing the likelihood of wobbling.

Figure 7:
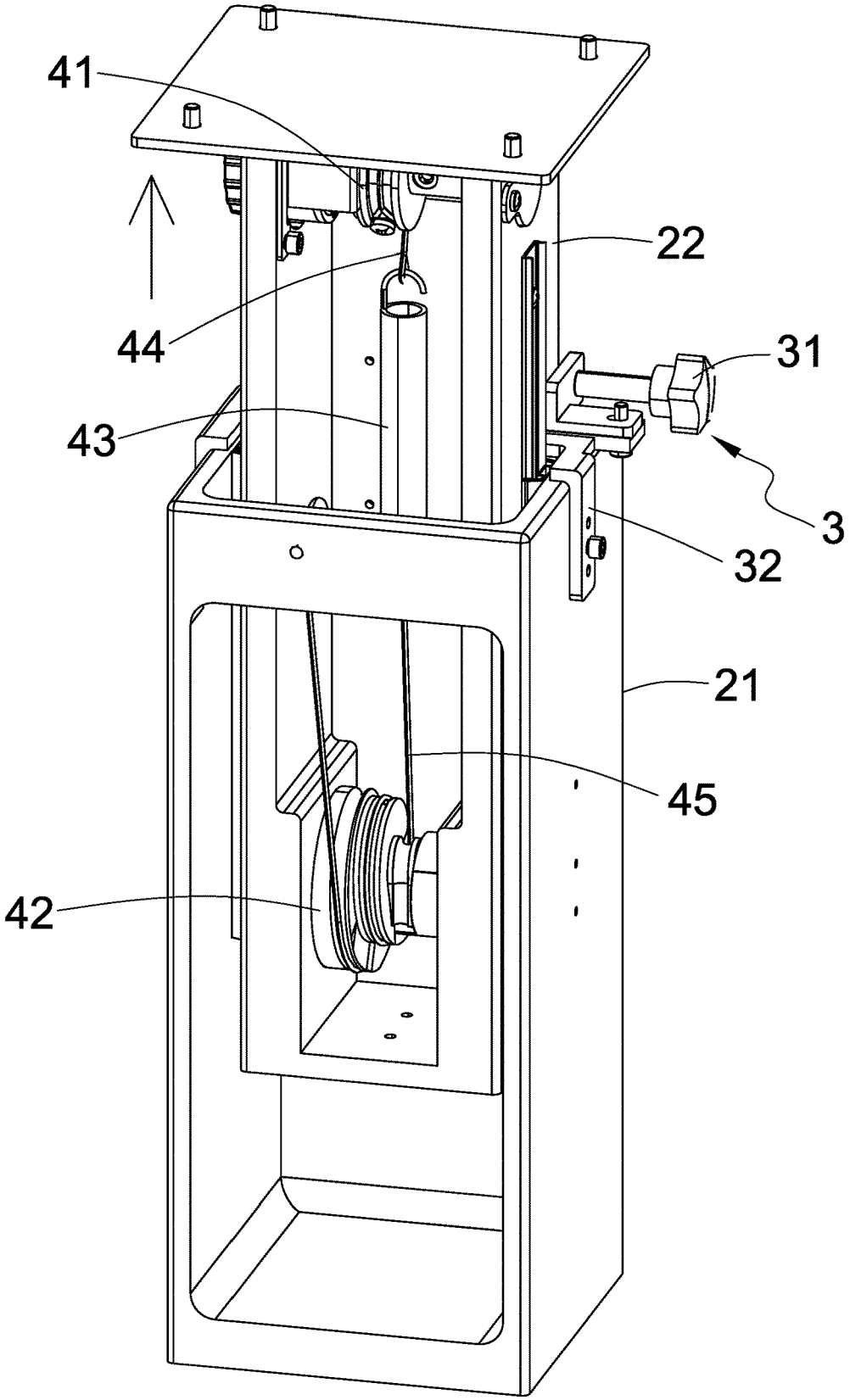
FIG. 7 is a perspective diagram showing a scenario that a tabletop of the height-adjustable table of FIG. 1 ascends.
Figure 7A:
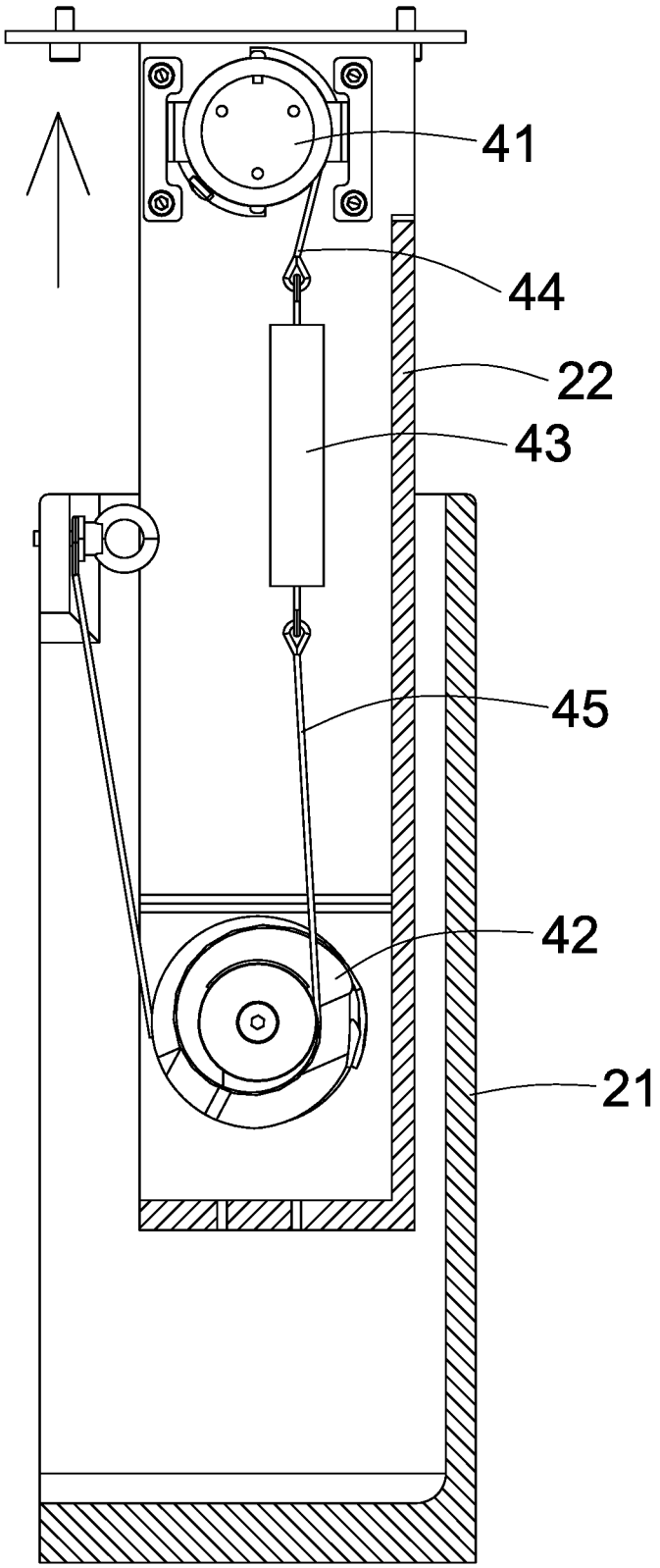
FIG. 7A is a sectional diagram showing a scenario that a tabletop of the height-adjustable table of FIG. 1 ascends.

As shown in FIGS. 2, 7, and 7A, when the tabletop 1 is subjected to an upward force, the lifting platform 22 can move upward through the rail structure 23. The lifting platform 22 ascends relative to the base 21. As the elastic piece 43 releases its stored energy, it provides kinetic energy for the lifting platform 22 to move upward. This shortens the time it takes for the tabletop 1 to ascend, allowing it to be positioned relatively quickly.

Figure 5:
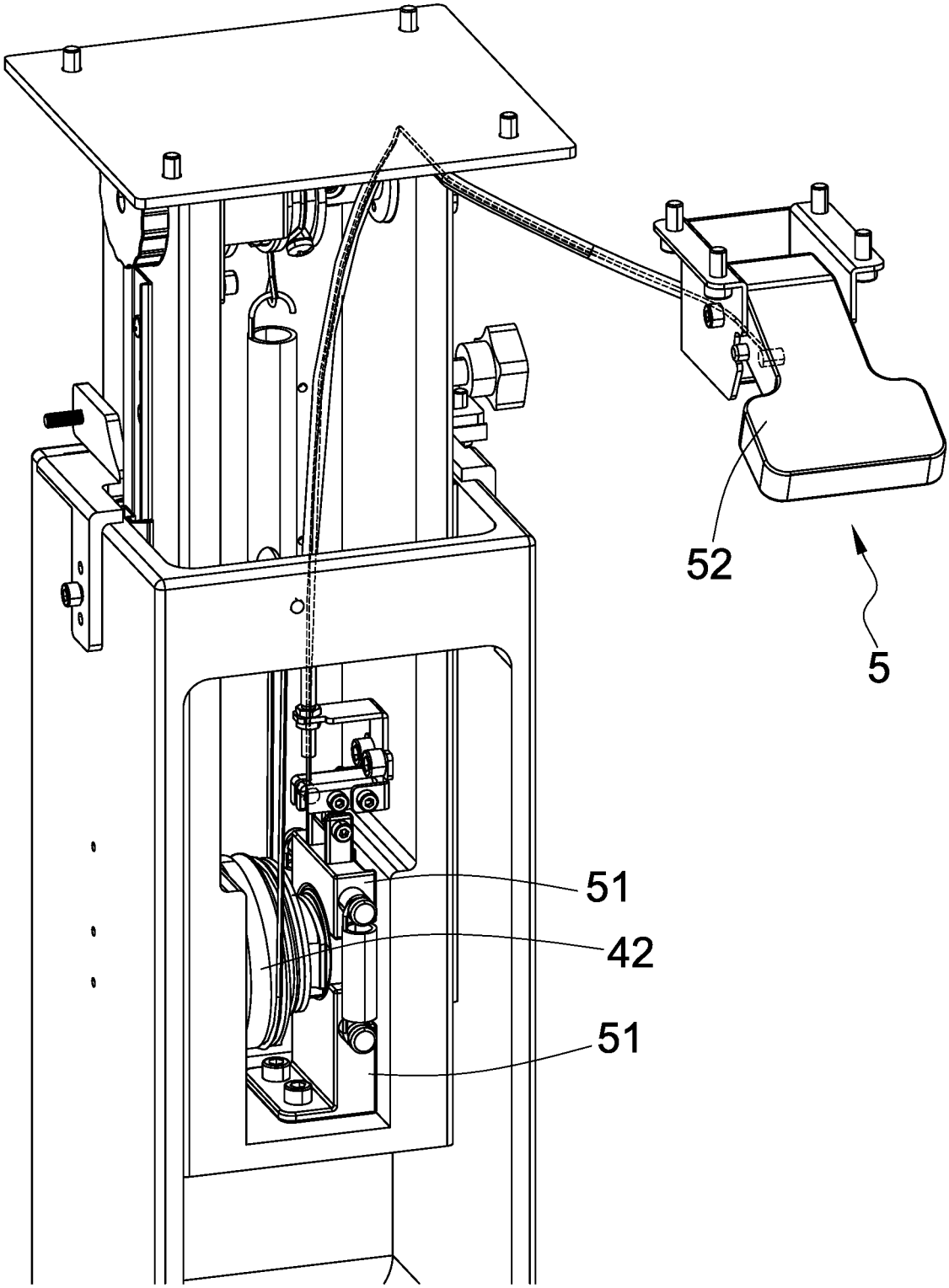
FIG. 5 is a perspective diagram showing a braking member of the height-adjustable table of FIG. 1.

As shown in FIGS. 2 and 5, the braking member 5 includes multiple brake pads 51 and a lever piece 52. The multiple brake pads 51 are positioned within the lifting platform 22 around the second pulley 42, and the lever piece 52 is connected to these brake pads 51. The lever piece 52 is joined to a side of the lifting member 2 can be used to actuate the multiple brake pads 51, causing them to clamp onto the second pulley 42, restricting its rotation. As a result, the second pulley 42 cannot rotate to wind the second rope 45, thereby affecting the movement of the lifting member 2.

As described above, the height-adjustable table utilizes the installation of the cushioning member 4 to enable the lifting platform 22 to smoothly ascend and descend relative to the base 21. Additionally, it uses the positioning member 3 to lock the lifting platform 22 at a desired position relative to the base 21. It can also use the braking member 5 to stop the lifting platform 22 from moving up and down.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A height-adjustable table, comprising a tabletop;

a lifting member, comprising a base and a lifting platform, where the lifting platform is slidably telescoped within the base, and the lifting platform is connected to the tabletop;

a positioning member configured on the base;

a cushioning member comprising a first pulley, a second pulley, and an elastic piece, where the first pulley and the second pulley are positioned inside the lifting platform, the elastic piece's two ends are respectively connected to a first rope and a second rope, the first rope is wrapped around the first pulley, the second rope is wrapped around the second pulley; and a braking member configured on the lifting member.

2. The height-adjustable table according to claim 1, wherein the lifting member further comprises a rail structure.

3. The height-adjustable table according to claim 1, wherein the positioning member comprises an operating piece and a locking piece; and the operating piece is connected to the locking piece.

4. The height-adjustable table according to claim 1, wherein the elastic piece is a spring.

5. The height-adjustable table according to claim 1, wherein the braking member comprises a plurality of brake pads and a lever piece; the brake pads are positioned within the lifting platform around the second pulley; and the lever piece is connected to the brake pads.

* * * * *